US006152360A

United States Patent [19]

Block et al.

[11] Patent Number: 6,152,360

[45] **Date of Patent: *Nov. 28, 2000**

[54] POUR SPOUT CARTON

[75] Inventors: Steven J. Block, Cincinnati, Ohio; Christopher J. Maurer, Portage, Mich.

[73] Assignee: Graphic Packaging Corporation, Golden, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/979,354

[22] Filed: Nov. 26, 1997

[51] Int. Cl.[7] ..... B65D 5/72

[52] U.S. Cl. ..... 229/215; 229/125.42; 222/531

[58] Field of Search ..... 229/215, 125.42, 229/210, 207, 219, 221, 160.2, 125.04, 125.08; 222/531, 533, 535

[56] References Cited

U.S. PATENT DOCUMENTS

| | | | |
|---|---|---|---|
| 883,738 | 4/1908 | Patterson et al. | 229/215 |
| 2,701,678 | 11/1955 | Read | 229/215 |
| 3,344,972 | 10/1967 | Robinson et al. . | |
| 3,362,612 | 1/1968 | Mohler | 229/215 |
| 4,168,003 | 9/1979 | Wysocki | 229/215 |
| 4,194,677 | 3/1980 | Wysocki | 229/215 |
| 4,921,104 | 5/1990 | Holmes | 229/215 |
| 5,215,250 | 6/1993 | Roccaforte | 229/215 |
| 5,531,376 | 7/1996 | Brink et al. . | |
| 5,660,324 | 8/1997 | Rowland | 229/125 |
| 5,678,755 | 10/1997 | Block . | |
| 5,720,430 | 2/1998 | Rowland | 229/215 |

*Primary Examiner*—Allan N. Shoap
*Assistant Examiner*—Tri M. Mai
*Attorney, Agent, or Firm*—Dorsey & Whitney LLP

[57] ABSTRACT

An improved pour spout assembly in a paperboard carton comprises a pour spout front panel formed from a section of a vertical side wall of the carton, and a component adhered to the interior surface of the side wall. The component has two sections separated by a frangible score. One section comprises a pour spout back panel and a pair of wings. The other section is a backboard having a pair of prongs that extend downward. Each prong forms a channel with an adjacent vertical edge of the pour spout opening to hold a wing in abutting relationship with the edge. The prongs also act as stoppers to prevent the pour spout from being pushed back into the interior of the carton.

7 Claims, 6 Drawing Sheets

POUR SPOUT CARTON

This invention is a paperboard carton having an improved pour spout.

BACKGROUND OF THE INVENTION

Pour spout cartons made entirely of paperboard are well known in the art. For example, U.S. Pat. 5,531,376, which is incorporated herein by reference, discloses a carton having a paperboard pour spout. The pour spout comprises a front panel that is formed from a section of a vertical side wall of the carton and that is hingedly connected thereto along a horizontal fold line for pivotal movement between a closed position and an open position. The front panel has a pair of vertical opposed side edges and an upper edge bridging the side edges. The perimeter of the front panel on the interior surface of the side wall defines a pour spout opening having two opposed vertical edges. There is a cutout above the front panel to enable one to grasp the upper edge of the front panel to open the pour spout. A back panel is adhered to the interior surface of the front panel. A pair of wings are hingedly connected to the back panel along opposed vertical parallel fold lines. A backboard is adhered to the interior surface of the side wall such that the backboard occludes the cutout to prevent undesired egress of the contents from the carton or ingress of foreign matter into the carton. The carton is made from a unitary blank, but it requires complicated folding and gluing to form the pour spout assembly, uses more paperboard than necessary, and has several layers of paperboard that interfere with stacking and machinability of the carton in form, fill and seal packaging machines. The pour spout carton of this invention is easy to manufacture from a minimal amount of paperboard, yet provides excellent performance in being siftproof, easy to open and reclose, and easy to stack and machine in form, fill and seal packaging machines.

SUMMARY OF THE INVENTION

The carton of this invention has an improved pour spout assembly compared to the pour spout assembly described in U.S. Pat. No. 5,531,376. In the improvement, the pour spout back panel, wings and backboard are provided by a component comprising a first section comprising the pour spout back panel and the wings, and a second section comprising the backboard. A frangible score separates the two sections. The backboard has a pair of prongs that project downward to define a narrow channel between an edge of each prong and a vertical edge of the pour spout opening for receiving a wing. The wing is held in abutting relationship with the vertical edge of the opening in a plane that is substantially perpendicular to the plane of the wall. The prongs, which project below the upper edge of the pour spout front panel, also prevent the pour spout front panel from being pushed back into the interior of the carton.

DESCRIPTION OF THE PREFERRED EMBODIMENTS

Figure 1:
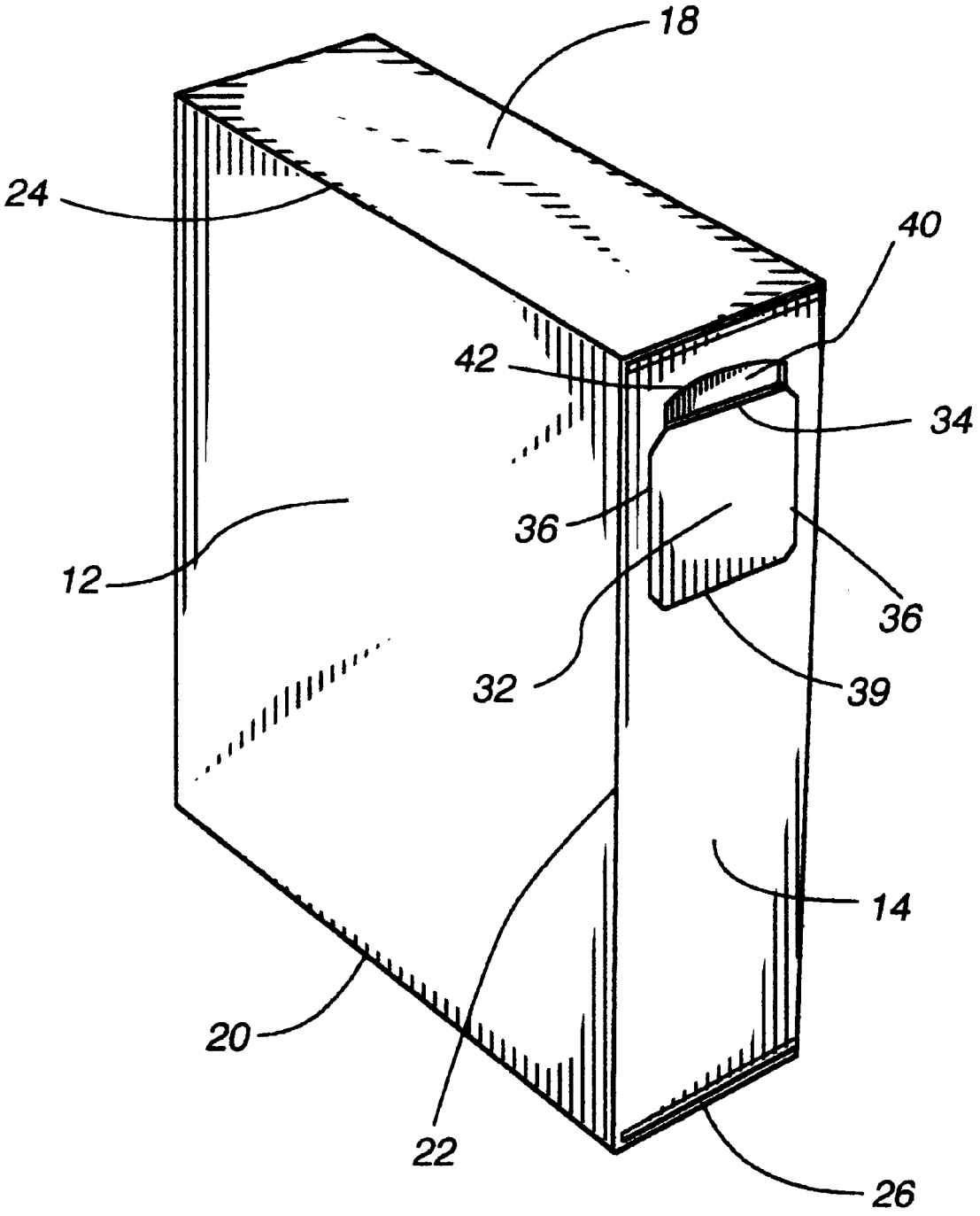
FIG. 1 is a perspective view of the carton of this invention showing the pour spout in the closed position.
Figure 2:
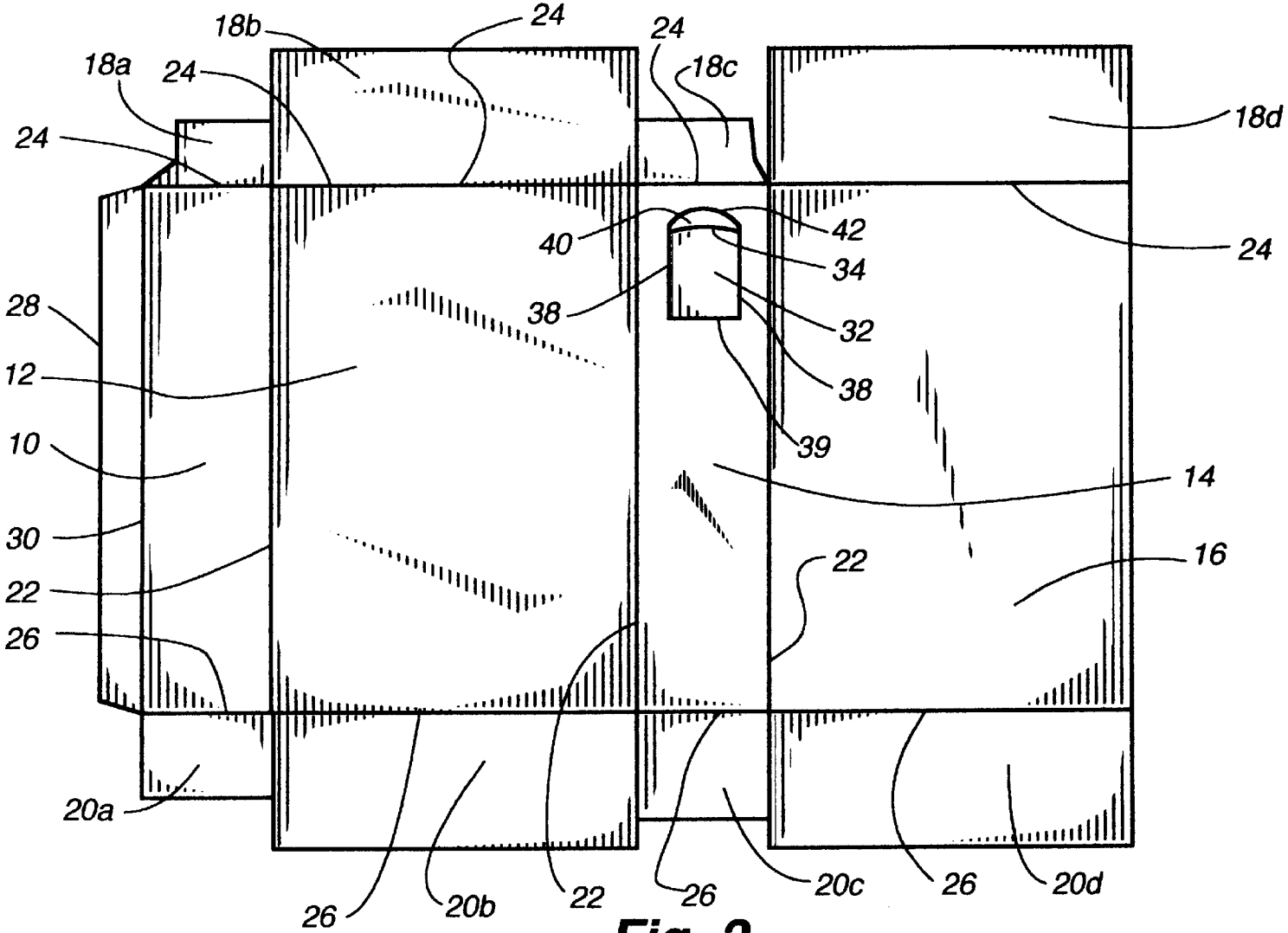
FIG. 2 is a plan view of the inside surface of a blank used to form the carton.

FIG. 1 illustrates the pour spout carton formed from the paperboard blank shown in FIG. 2. The carton has four side walls 10, 12, 14 and 16, a top wall 18, and a bottom wall 20. The side walls are hingedly connected to one another along vertical fold lines 22. The top wall 18 is formed from closure flaps 18*a*, 18*b*, 18*c* and 18*d* that are hingedly connected to wall panels 10, 12, 14 and 16, respectively, along horizontal fold lines 24. The bottom wall 20 is formed from closure flaps 20*a*, 20*b*, 20*c* and 20*d* that are hingedly connected to wall panels 10, 12, 14 and 16, respectively, along horizontal fold lines 26. A glue flap 28 is hingedly connected to the side panel 10 along vertical fold line 30.

Figure 5:
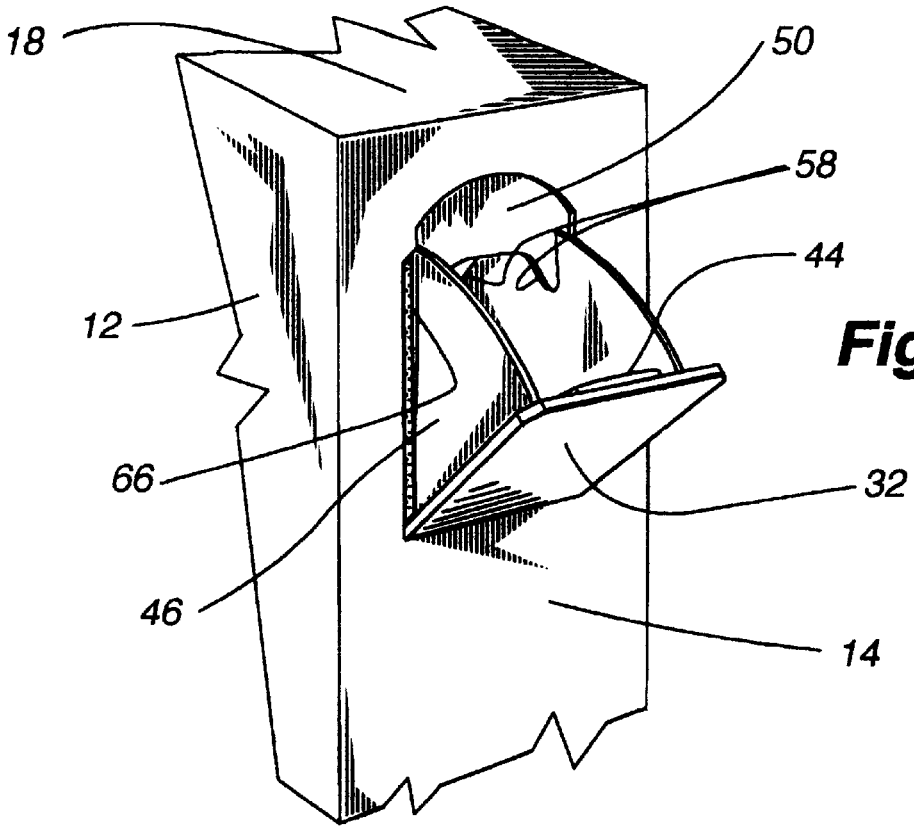
FIG. 5 is a partial perspective view of the carton showing the pour spout in the open position.
Figure 6:
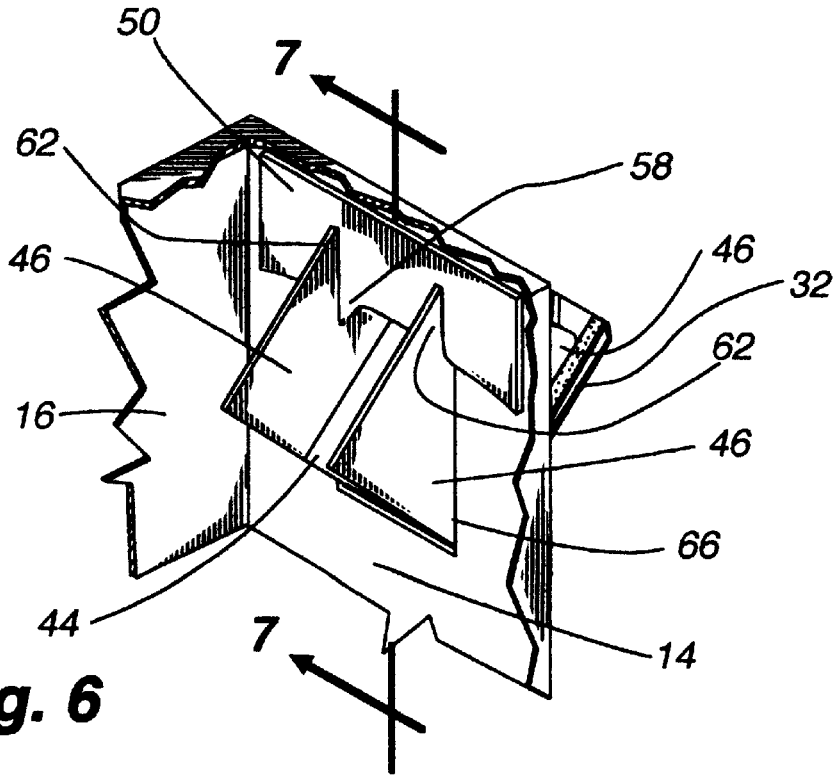
FIG. 6 is a partial perspective view of the carton showing the pour spout in the open position as seen from the interior of the carton.
Figure 7:
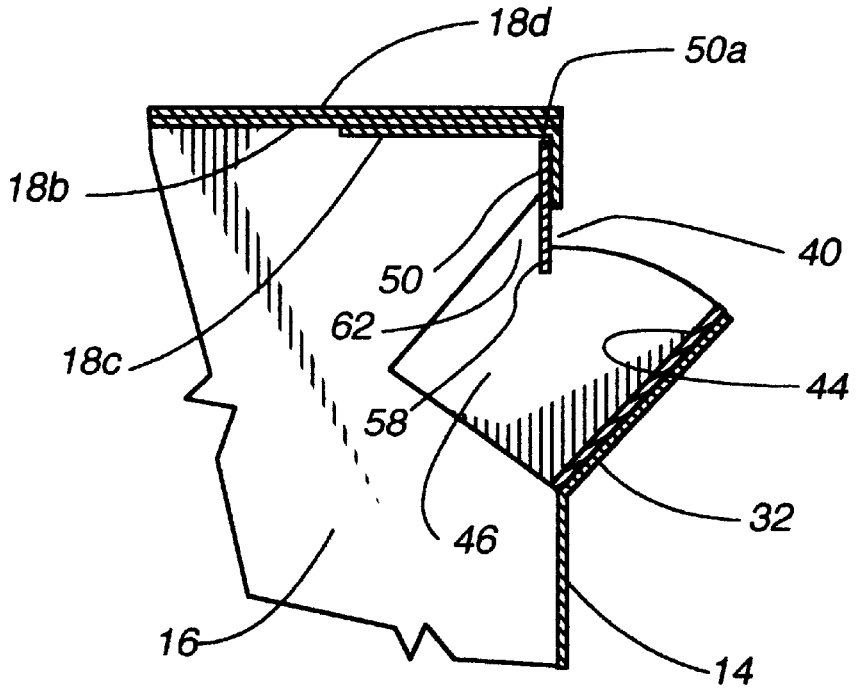
FIG. 7 is a sectional view taken along line 7—7 in FIG. 6.
Figure 8:
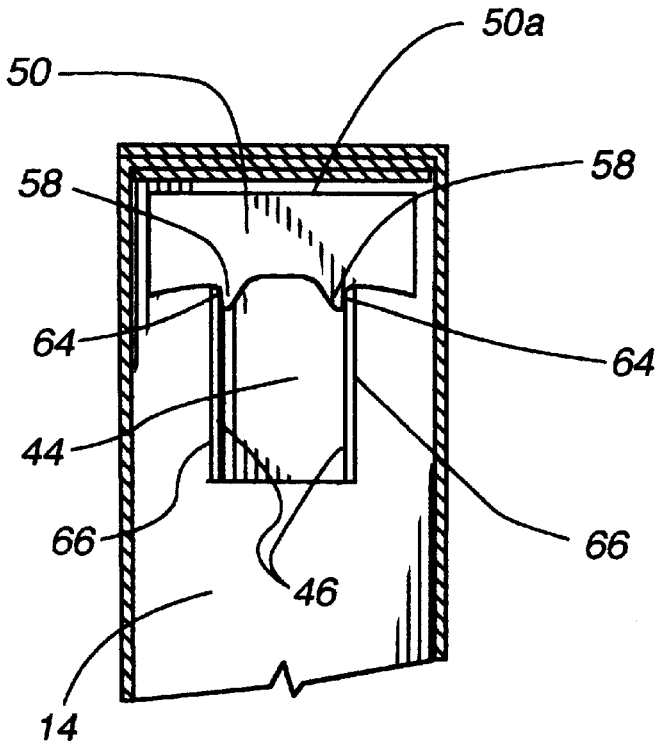
FIG. 8 is a partial sectional view of the carton showing the pour spout in the closed position as seen from the interior of the carton.

The carton has a pour spout front panel 32 that is formed from a section of the side wall 14 by cut score 34, vertical parallel partial cut scores 36 on the exterior surface, vertical parallel partial cut scores 38 on the interior surface, and horizontal fold line 39. The exterior partial cut scores 36 and the interior partial cut score 38 are offset slightly, such as about five millimeters, from each other. This combination of partial cut scores is referred to in the art as reverse cuts. The fold line 39 acts as a hinge to allow the pour spout front panel to pivot from a closed position, as seen in FIGS. 1 and 8, to an open position, as seen in FIGS. 5–7.

A cutout 40 is formed above the pour spout front panel by cut scores 34 and 42.

Figure 3:
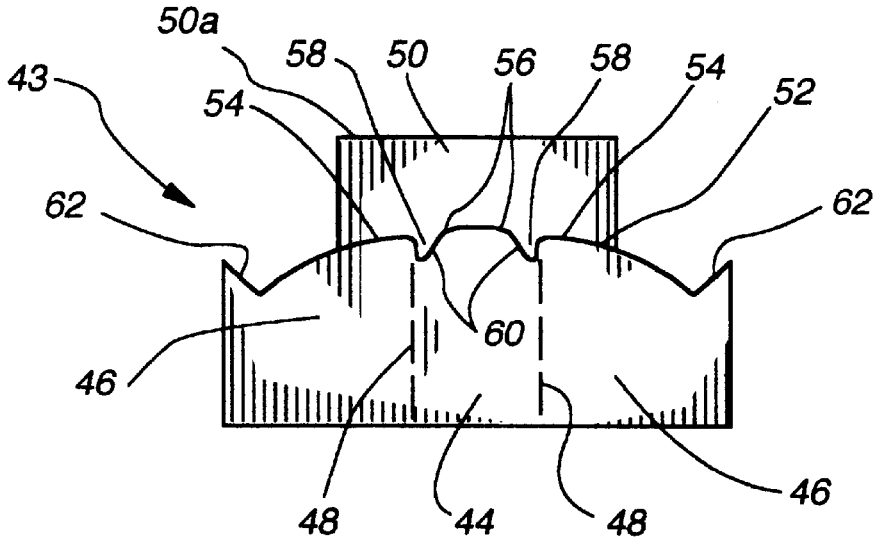
FIG. 3 is a plan view of a component of the carton that is glued to the blank shown in FIG. 2.
Figure 4:
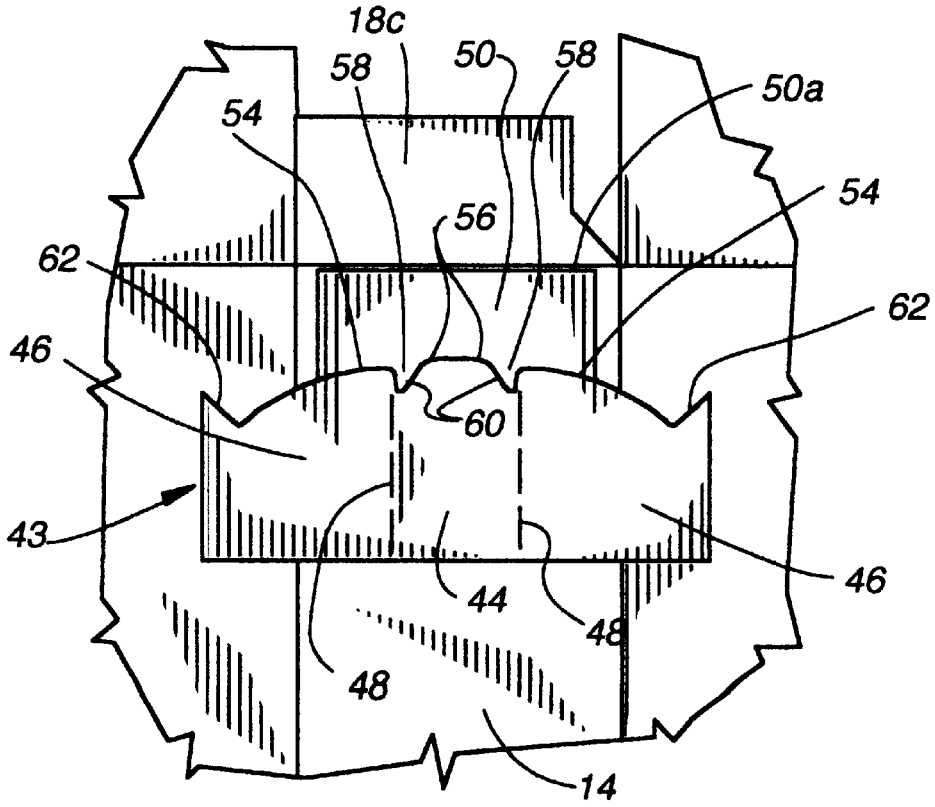
FIG. 4 is a partial plan view of the blank with the component shown in FIG. 3 glued to it.

FIG. 3 illustrates a component 43 that is glued to the interior surface of wall panel 14. The component comprises a pour spout back panel 44, wings 46 that are hingedly connected to the pour spout back panel 44 along fold lines 48, and a backboard panel 50. A cut score 52 separates the backboard panel 50 from the pour spout back panel 44 and wings 46 except where a hiatus in the cut score 52 results in a narrow bridge (less than about one millimeter wide) between the two sections. Such bridges are referred to in the art and herein as nicks. Two nicks 54 connect the backboard panel 50 to the wings 46 and two nicks 56 connect the backboard panel 50 to the pour spout back panel 44. The backboard panel 50 includes two prongs 58 that extend downward, thereby creating two corresponding indentations 60 in the pour spout back panel 44. Each wing 46 includes a stopper 62. The component illustrated in FIGS. 3 and 4 is shown in larger scale than the carton blank illustrated in FIG. 2. The backboard panel 50 is vertically oriented in the carton and is cut off along its entire upper edge 50*a*.

As shown in FIG. 4, the component 43 illustrated in FIG. 3 is glued to the interior surface of wall panel 14 such that the pour spout back panel 44 is adhered to the pour spout front panel 32 and coincides with it except for the indentations 60. The backboard 50 is adhered to the area above the pour spout front panel 32, and occludes the cutout 40 to prevent leakage of the contents of the carton. The wings 46 are not glued.

After the component 43 has been glued to the wall panel 14, the blank is folded and glued in conventional manner to form the carton shown in FIG. 1. In the process, the nicks 54 are broken to allow the wings 46 to pivot about fold lines 48.

To open the carton, the consumer inserts her finger into the cut out 40, engages the upper edge of the pour spout front panel 32 with her fingernail, and pulls outwardly. The force of the pull causes the narrow strips of paperboard between the reverse cuts 36 and 38 to delaminate, thereby allowing the pour spout front panel to pivot down about fold line 39. The force of the pull also breaks the nicks 56 to allow the pour spout back panel 44 to pivot with the pour spout front panel 32. The wings 46 follow the pour spout back panel 44 until the stoppers 62 abut the backboard 50, as shown in FIGS. 6 and 7.

Each prong 58 forms a narrow channel 64 (best seen in FIG. 8) with a vertical edge 66 of the pour spout opening that is formed when the pour spout is opened, with the partial cut scores 38 being converted into the free edges 66. As the upper margin of each wing 46 passes through the channel 64, the channel 64 holds the wing 46 in an abutting relationship with the edge 66 in a plane that is substantially perpendicular to the plane of the side wall 14, thereby preventing the contents of the carton from leaking between the wing 46 and the edge 66.

When the pour spout is returned to its closed position, the prongs 58 abut the pour spout front panel 32 when it returns to the vertical plane, thereby preventing the pour spout front panel 32 from being pushed back into the carton.

If desired, a peelable label may be applied over the pour spout when the carton is filled to prevent sifting of the contents, but one of the advantages of this invention is that it provides improved resistance to sifting.

Figure 9:
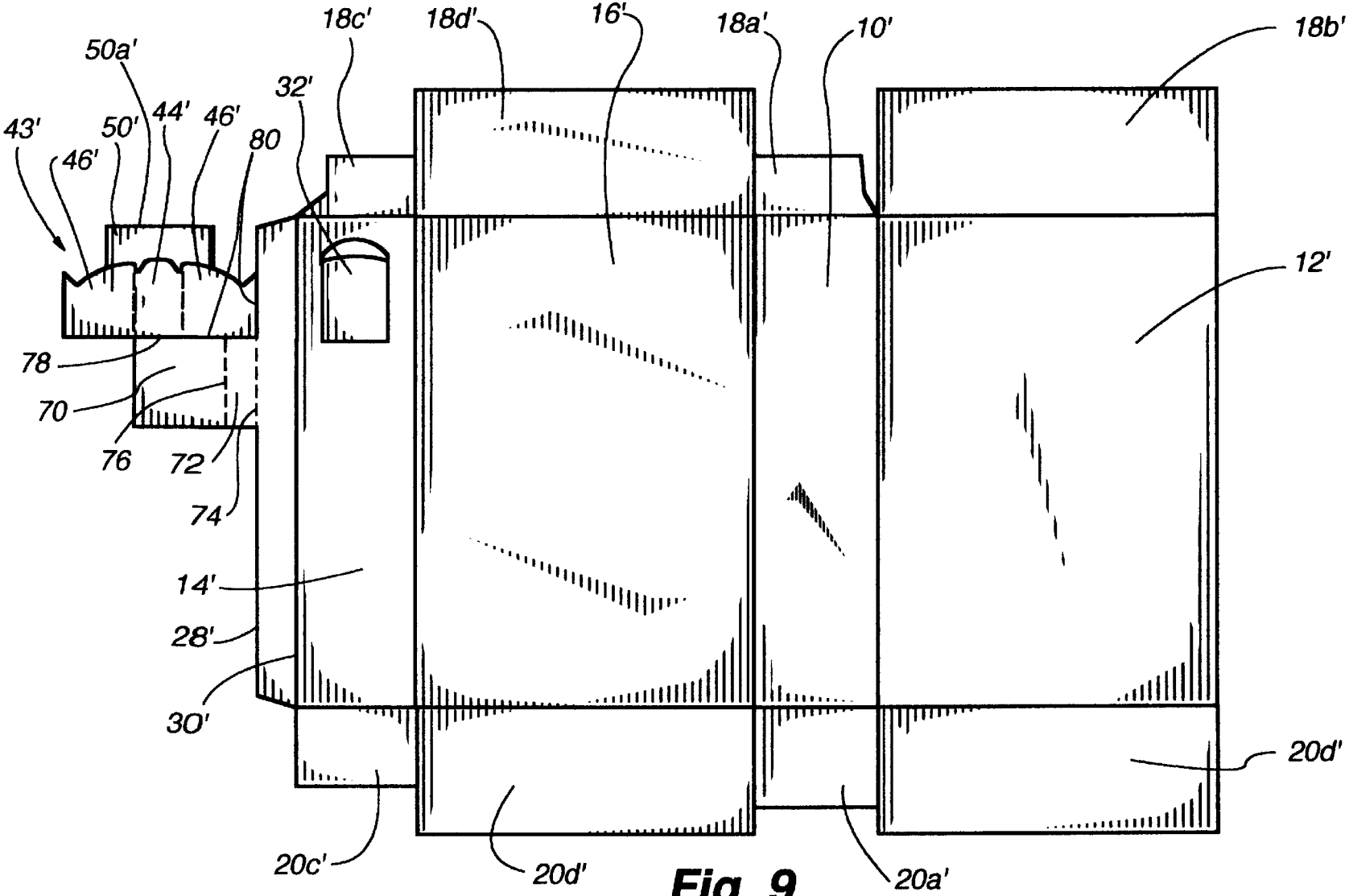
FIG. 9 is a plan view of the inside surface of a unitary blank for forming another embodiment of the carton of this invention.

If desired, component 43 can be an integral part of the carton blank, such as by being hingedly connected, directly or indirectly, to the side panel in which the spout is located. FIG. 9 illustrates such an embodiment where component 43' is hingedly connected through span panels 70 and 72 to the glue flap 28' along fold line 74. The width of span panel 72 is substantially the same as the width of glue flap 28'. Glue flap 28' is hingedly connected along fold line 30' to the sidewall panel 14' in which the pour spout front panel 32' is formed. The remainder of the carton corresponds to the carton shown in FIG. 2, mutatis mutandis, with corresponding reference numerals denoted by the prime symbol. There is a fold line 76 between the span panels 70 and 72, and a fold line 78 between span panel 70 and the pour spout back panel 44'. The wing 46' adjacent the glue flap 28' and the span panels 70 and 72 is separated from them by cut scores 80. The carton is formed by applying glue to the backboard panel 50' and the span panels 70 and 72, folding the component 43' and the span panels 70 and 72 180° about fold line 74 to glue the backboard panel 50' and the span panels 70 and 72 to the interior surface of the side wall 14', and then completing formation of the carton in conventional manner.

What is claimed is:

1. In a carton having an interior, a vertical side wall and a paperboard pour spout assembly comprising a pour spout front panel formed from a section of the side wall and hingedly connected thereto along a horizontal fold line for pivoting between a closed position and an open position, the pour spout front panel have a pair of opposed generally vertical side edges and an upper edge bridging the side edges, a perimeter of the pour spout front panel on an interior surface of the side wall defining a pour spout opening having two opposed vertical edges, a cutout above the pour spout front panel to enable on to grasp the upper edge of the pour spout front panel, a pour spout back panel adhered to the interior surface of the pour spout front panel, a pair of wings hingedly connected to the pour spout back panel along opposed parallel fold lines, and a vertical backboard adhered to the interior surface of the side wall such that the vertical backboard occludes the cutout, the improvement wherein the pour spout back panel, wings and vertical backboard are provided by a separate component comprising a first section comprising the pour spout back panel and the wings, and a second section comprising the vertical backboard the first section having a sinuous first upper edge extending along a top edge of the pour spout back panel and along an upper margin of each wing, and the second section hang a second upper edge and a sinuous second lower edge, the separate component having a frangible score separating the first and second sections, the frangible score extending entirely along the sinuous second lower edge and partially along the sinuous first upper edge to include the top edge of the pour spout back panel and a portion of the upper margins of the wings, the vertical backboard having a pair of prongs along the sinuous second lower edge that project downwardly into corresponding indentations in the top edge of the pour spout back panel along the sinuous first upper edge, each of the prongs defining a narrow channel between an edge of each of the prongs and one vertical edge of the two opposed vertical edges of the pour spout opening, the narrow channel for receiving one wing of the pair of wings, whereby the one wing is held in abutting relationship with the one vertical edge in a plane that is substantially perpendicular to the plane of the side wall, the vertical backboard being cut-off entirely along the upper edge thereof.

2. The improvement of claim 1 wherein the prongs project below the upper edge of the pour spout front panel, whereby the prongs prevent the pour spout front panel from being pushed back into the interior of the carton when in the closed position.

3. The improvement of claim 2 wherein the pour spout back panel coincides with and substantially conforms wit the pour spout front panel except for the indentations in the top edge of the pour spout back panel corresponding to the prongs.

4. A carton having an interior, a plurality of vertical side walls and a paperboard pour spout assembly, the pour spout assembly comprising a pour spout front panel formed from a section of one of the side walls and hingedly connected to the one side wall along a horizontal fold line fox pivoting between a closed position and an open position, the pour spout front panel having a pair of opposed generally vertical side edges and an upper edge extending between the side edges, the pour spout having a perimeter defining a pour spout opening having two opposed vertical edges and a cutout above the pour spout front panel to permit grasping of the upper edge of the pour spout front panel, said pour spout assembly also comprising a one-piece component that includes a first section connected to a second section with a cut score provided between the first and second sections, the first section of the one-piece component including a pour spout back panel adhered to an interior surface of the pour spout front panel and a pair of wings hingedly connected to the pour spout back panel along opposed fold lines, and the second section of the one-piece component including a vertical backboard adhered to an interior surface of the one side wall such that the vertical backboard occludes the cutout, the first section having a sinuous first upper edge extending along a top edge of the pour spout back panel and along an upper margin of each wing, and the second section having a second upper edge and a sinuous second lower edge, the cut score extending entirely along the sinuous second lower edge and partially along the sinuous first upper edge to include the top edge of the pour spout back panel and a portion of the upper margins of the wings, the vertical backboard having a pair of prongs along the sinuous second lower edge that project downwardly into corresponding indentations in the top edge of the pour spout back panel along the sinuous first upper edge, each of the prongs defining a narrow channel between an edge of each of the prongs and one vertical edge of the two opposed vertical edges of the pour spout opening, the narrow channel for receiving one wing of the pair of wings during pivoting of the pour spout front panel to the open position, the vertical backboard being cut-off along an entire upper edge thereof.

5. The carton of claim 4, wherein the prongs along the sinuous second lower edge project below the upper edge of the pout spout front panel to prevent the pour spout front panel from being pushed back into the interior of the carton when the pour spout front panel is pivoted from the open position to the closed position.

6. The carton of claim 4, wherein the pour spout back panel substantially corresponds in shape to the pour spout front panel except fox the indentations in the pour spout back panel corresponding to the prongs.

7. The carton of claim 4, wherein the first and second sections of the one-piece component are connected by nicks.

* * * * *

UNITED STATES PATENT AND TRADEMARK OFFICE

CERTIFICATE OF CORRECTION

PATENT NO. : 6,152,360
DATED : November 28, 2000
INVENTOR(S) : Steven J. Block and Christopher J. Maurer It is certified that error appears in the above-identified patent and that said Letters Patent is hereby corrected as shown below:

Column 4,
Line 2, "on" and insert -- one --;
Line 16, delete "hang" and insert -- having --;
Line 41, delete "wit" and insert -- with --; and
Line 49, delete "fox" and insert -- for --.

Column 6,
Line 11, delete "fox" and insert -- for --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*